US007665309B2

(12) United States Patent
Parker et al.

(10) Patent No.: US 7,665,309 B2
(45) Date of Patent: Feb. 23, 2010

(54) SECONDARY FUEL DELIVERY SYSTEM

(75) Inventors: David M. Parker, Oviedo, FL (US); Weidong Cai, Oviedo, FL (US); Daniel W. Garan, Orlando, FL (US); Arthur J. Harris, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 12/210,356

(22) Filed: Sep. 15, 2008

(65) Prior Publication Data

US 2009/0071159 A1 Mar. 19, 2009

Related U.S. Application Data

(63) Continuation-in-part of application No. 12/194,611, filed on Aug. 20, 2008.

(60) Provisional application No. 60/972,405, filed on Sep. 14, 2007, provisional application No. 60/972,395, filed on Sep. 14, 2007.

(51) Int. Cl.
*F02C 7/26* (2006.01)

(52) U.S. Cl. ..... 60/776; 60/740; 60/746

(58) Field of Classification Search ..... 60/733, 60/740, 736, 737, 776, 805, 789, 747, 746, 60/723, 739

See application file for complete search history.

(56) References Cited

U.S. PATENT DOCUMENTS

| | | | | |
|---|---|---|---|---|
| 3,055,179 | A | | 9/1962 | Lefebvre et al. |
| 3,099,134 | A | | 7/1963 | Calder et al. |
| 3,872,664 | A | | 3/1975 | Lohmann et al. |
| 3,934,409 | A | | 1/1976 | Quillevere et al. |
| 4,028,888 | A | | 6/1977 | Pilarczyk |
| 4,192,139 | A | | 3/1980 | Buchheim |
| 4,265,615 | A | | 5/1981 | Lohmann et al. |
| 4,420,929 | A | | 12/1983 | Jorgensen et al. |
| 4,590,769 | A | | 5/1986 | Lohmann et al. |
| 4,928,481 | A | * | 5/1990 | Joshi et al. ..... 60/737 |
| 5,274,991 | A | * | 1/1994 | Fitts ..... 60/800 |
| 5,394,688 | A | | 3/1995 | Amos |
| 5,408,825 | A | | 4/1995 | Foss et al. |
| 5,479,782 | A | | 1/1996 | Parker et al. |
| 5,623,819 | A | | 4/1997 | Bowker et al. |
| 5,640,851 | A | | 6/1997 | Toon et al. |
| 5,647,215 | A | | 7/1997 | Sharifi et al. |
| 5,657,632 | A | | 8/1997 | Foss |
| 5,687,571 | A | | 11/1997 | Althaus et al. |
| 5,749,219 | A | | 5/1998 | DuBell |

(Continued)

*Primary Examiner*—Michael Cuff
*Assistant Examiner*—Phutthiwat Wongwian

(57) ABSTRACT

A secondary fuel delivery system for delivering a secondary stream of fuel and/or diluent to a secondary combustion zone located in the transition piece of a combustion engine, downstream of the engine primary combustion region is disclosed. The system includes a manifold formed integral to, and surrounding a portion of, the transition piece, a manifold inlet port, and a collection of injection nozzles. A flowsleeve augments fuel/diluent flow velocity and improves the system cooling effectiveness. Passive cooling elements, including effusion cooling holes located within the transition boundary and thermal-stress-dissipating gaps that resist thermal stress accumulation, provide supplemental heat dissipation in key areas. The system delivers a secondary fuel/diluent mixture to a secondary combustion zone located along the length of the transition piece, while reducing the impact of elevated vibration levels found within the transition piece and avoiding the heat dissipation difficulties often associated with traditional vibration reduction methods.

10 Claims, 3 Drawing Sheets

U.S. PATENT DOCUMENTS 5,802,854 A 9/1998 Maeda et al.
5,826,429 A 10/1998 Beebe et al.
5,850,731 A 12/1998 Beebe et al.
6,047,550 A 4/2000 Beebe
6,092,363 A 7/2000 Ryan
6,192,688 B1 2/2001 Beebe
6,343,462 B1 * 2/2002 Drnevich et al. ..... 60/775
6,418,725 B1 7/2002 Maeda et al.
6,513,334 B2 2/2003 Varney
6,868,676 B1 3/2005 Haynes
7,082,770 B2 8/2006 Martlling et al.
7,198,483 B2 4/2007 Bueche et al.
7,302,801 B2 12/2007 Chen
7,303,388 B2 12/2007 Joshi et al.
2001/0049932 A1 12/2001 Beebe
2003/0010035 A1 * 1/2003 Farmer et al. ..... 60/752
2003/0024234 A1 2/2003 Holm et al.
2007/0234733 A1 10/2007 Harris et al.
2008/0072599 A1 * 3/2008 Morenko et al. ..... 60/734

* cited by examiner

SECONDARY FUEL DELIVERY SYSTEM

CROSS-REFERENCE TO RELATED APPLICATIONS

This invention claims priority to U.S. Provisional application 60/972,405 filed on Sep. 14, 2007 entitled, "Fuel Manifold for Axially Staged Combustion System". This invention is also a Continuation in Part of US application entitled, "Apparatus and Method for Controlling the Secondary Injection of Fuel", filed on Aug. 20, 2008 and having a Ser. No. 12/194,611, which, in turn, claims priority to U.S. Provisional application 60/972,395 entitled, "Apparatus and Method for Controlling the Secondary Injection of Fuel." Each of these above-mentioned applications is herein incorporated by reference.

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates generally to the field of axially-staged combustors and, more particularly, to a secondary fuel delivery system having improved vibration attenuation and cooling features.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One combustor design includes a centralized pilot nozzle and several main fuel injector nozzles, not shown, arranged circumferentially around the pilot nozzle. With that design, the nozzles are arranged to form a pilot flame zone and a mixing region. During operation, the pilot nozzle selectively produces a stable flame which is anchored in the pilot flame zone, while the main nozzles produce a mixed stream of fuel and air in the above-referenced mixing region. The stream of mixed fuel and air flows out of the mixing region, past the pilot flame zone, and into a main combustion zone, where additional combustion occurs. Energy released during combustion is captured by the downstream components to produce electricity or otherwise do work.

The primary air pollutants produced by gas turbines are oxides of nitrogen, carbon monoxide and unburned hydrocarbons. For many years now, the typical combustor has included a primary injection system at a front end thereof to introduce fuel into the combustion chamber along with compressed air from compressor section. Typically, the fuel and air are premixed and then introduced into an igniter to produce a flowing combustion stream that travels along a length of the combustion chamber and through the transition piece to the first row of turbine blades. One challenge in such single site injection systems is there is always a balance to be obtained between the combustion temperature and the efficiency of the combustor. The amount of energy released during combustion is a product of many factors, including the temperature at which the combustion takes place, with increases in combustion temperature generally resulting in increased energy release. However, while increasing the combustion temperature can produce increased energy levels, it can also have negative results, including increased production of unwanted emissions, such as oxides of nitrogen (NOx), for which overall levels are directly related to the length of time spent at elevated temperatures. While high temperatures generally provide greater combustion efficiency, the high temperatures also produce higher levels of NOx.

Recently, combustors have been developed that also introduce a secondary fuel into the combustor. For example, U.S. Pat. Nos. 6,047,550, 6,192,688, 6,418,725, and 6,868,676, all disclose secondary fuel injection systems for introducing a secondary air/fuel mixture downstream from a primary injection source into the compressed air stream traveling down a length of the combustor. These systems introduce fuel at a later point in the combustion process and reduce at least some NOx levels by shortening the residence time of the added fuel with respect to the primary fuel and by maintaining an overall-lower combustion temperature by adding less fuel at the head end. However, even with these advancements, there remains a need for a secondary fuel supply system specifically designed to address the excessive levels of vibration found in some sections of the engine, like the transition piece. The transition piece can, for example, be a difficult place in which to mount a secondary fuel delivery system, because it is prone to especially-high levels of vibration, and placing known secondary fuel delivery systems there will subject them to forces which, if not addressed, can lead to excessive wear and can cause premature failure. Use of traditional vibration reduction methods, such as increasing component mass to improve stiffness, present additional difficulties when applied to the transition section, because the additional bulk is not only difficult to cool, but it can also interfere with the delicate aerodynamic characteristics of the flow path, leading to overall losses in efficiency and/or performance issues. Therefore, there still remains a need in this field for a fuel delivery system that, in addition to providing a supply of fuel and/or diluent to a secondary combustion region in the transition piece, downstream of a primary combustion zone, also includes features that address elevated levels of vibration, while maintaining sufficient cooling in the area surrounding the secondary combustion zone.

SUMMARY OF THE INVENTION

The instant invention is a secondary fuel/diluent delivery system having vibration-attenuation and heat dissipation features suitable for delivery of fuel to a secondary combustion zone downstream of a primary combustion zone within a combustion engine. The system includes a transition piece having an integrated fuel/diluent manifold section, along with a fuel/diluent input port and secondary fuel/diluent dispensing injectors. The manifold section includes active heat dissipation features that work with flow-velocity-augmenting elements to cooperatively cool the system. The manifold may also include passive cooling elements that provide supplemental heat dissipation in key areas, along with thermal-stress-dissipating gaps that resist thermal stress accumulation tendencies associated with cyclic loading during operation.

This arrangement advantageously delivers a secondary fuel/diluent mixture to a secondary combustion zone located along the length of the transition piece, while reducing the impact of elevated vibration levels found within the transition piece and avoiding the heat dissipation difficulties often associated with traditional vibration reduction methods.

Accordingly, it is an object of the present invention to provide a secondary fuel/diluent delivery system that includes active heat dissipation features and flow-velocity-augmentation elements that cooperatively cool the system.

It is another object of the present invention to provide a secondary fuel/diluent delivery system that includes passive cooling elements that provide supplemental heat dissipation is key areas, along with thermal-stress-dissipating gaps that resist thermal stress build up due to cyclic loading during operation.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
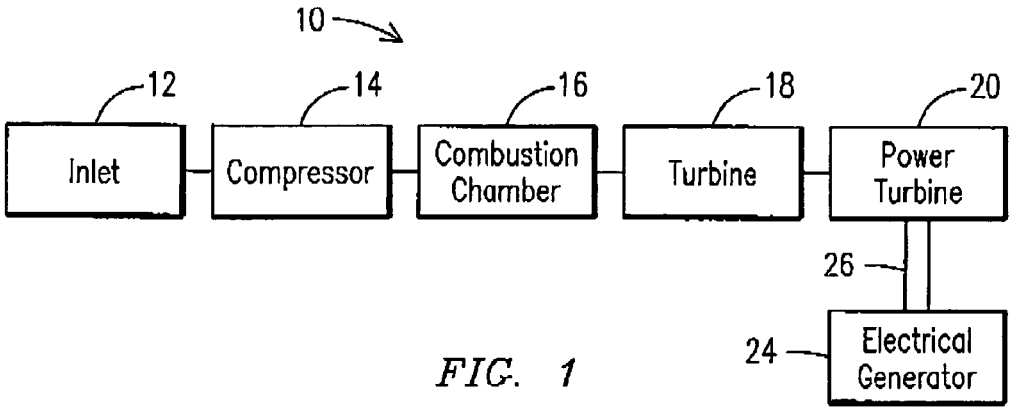
FIG. 1 is schematic representation of a combustion engine in which the secondary fuel delivery system of the present invention may be used.
Figure 2:
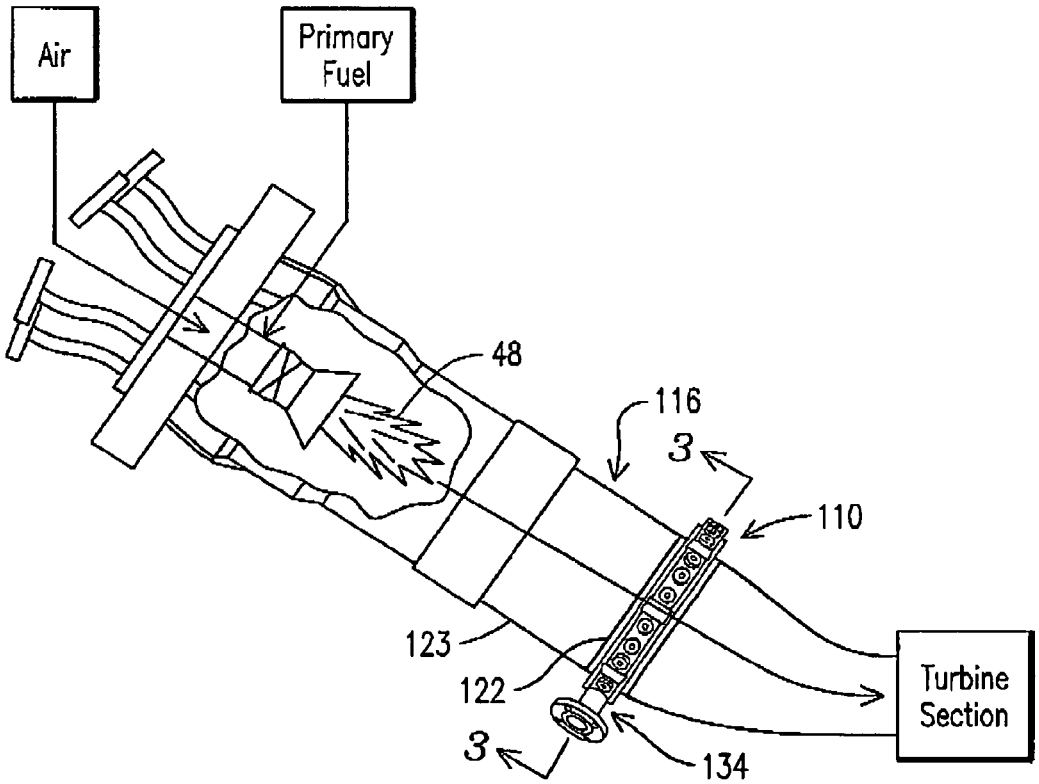
FIG. 2 is a side, partial cutaway view of a combustor employing the secondary fuel delivery system of the present invention.
Figure 3:
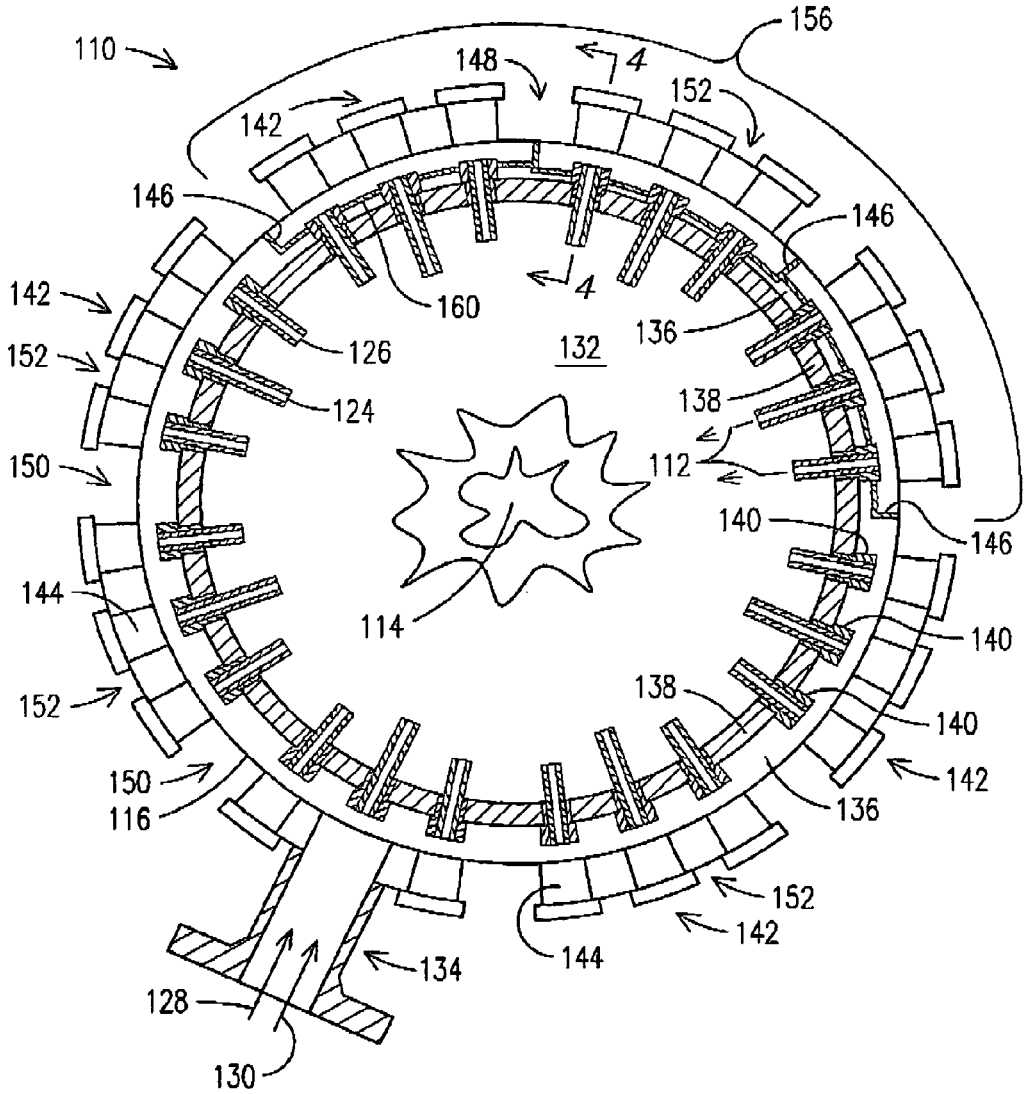
FIG. 3 is a cross-section view of the manifold of the present invention taken along cutting line 3-3 in FIG. 2.
Figure 4:
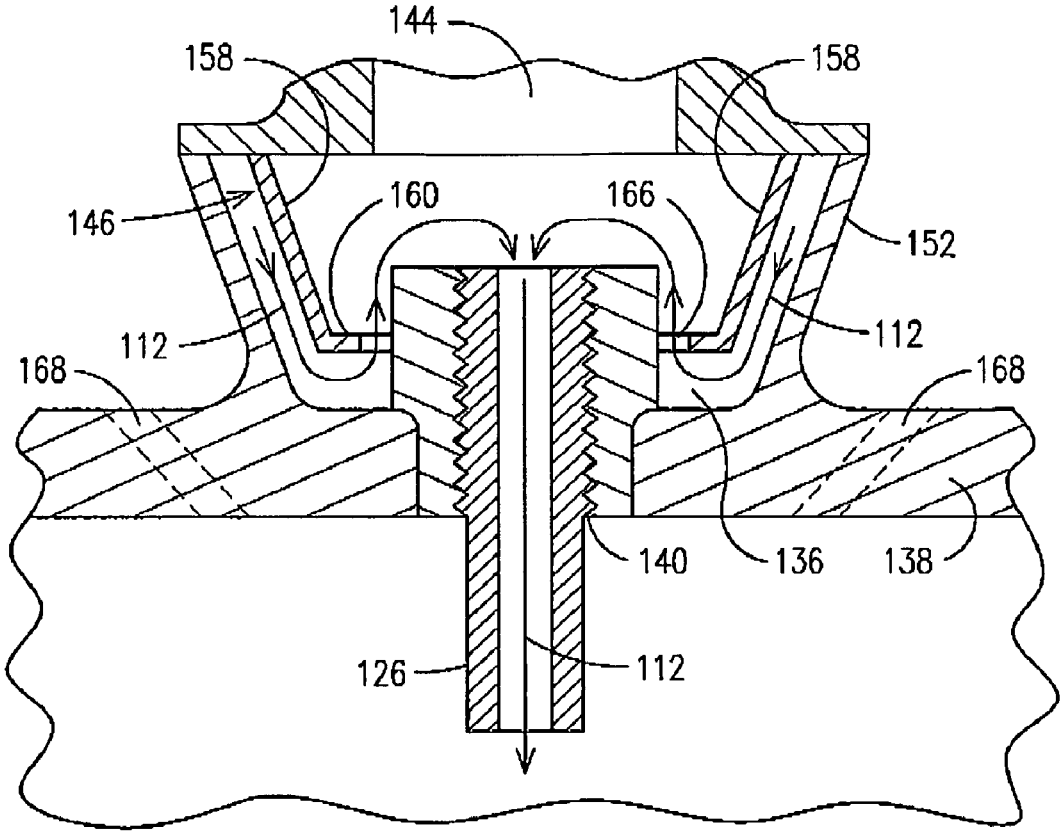
FIG. 4 is a cross-section view of the manifold of the present invention taken along cutting line 4-4 in FIG. 3

Reference is now made in general to the figures, wherein the secondary fuel delivery system 110 of the present invention is shown. As shown in FIGS. 2, 3, and 4, the fuel delivery system 110 is especially-suited for providing a secondary stream 112 of fuel and/or diluent to a secondary combustion zone 114, located within the transition piece 116, downstream of the primary combustion zone 48, as a way of, among other things, reducing NOx emissions levels during operation of the associated turbine engine, not shown. By way of overview, and with additional reference to FIG. 3, the secondary fuel delivery system 110 includes a manifold 122 disposed circumferentially around the transition piece 116, a manifold inlet port 134 through which a secondary supply of fuel 128 and/or diluent 130 enters the manifold main cavity 136, and a plurality of long and short injector nozzles 124, 126 for distributing fuel and/or diluent into a secondary combustion zone 114 located in the interior region 132 of the transition piece 116. As will be described more-fully below, a strategically-positioned flowsleeve 146 ensures fuel/diluent flow velocity in the manifold 122 at key locations away from the inlet 134 is maintained at levels effective to provide adequate transition piece cooling.

With particular reference to FIG. 3, the manifold 122 is formed integral to the boundary wall 123 of the transition piece 116. By integrating the manifold 122 into the transition 116, the transition of the present invention is easy to manufacture and is resistant to modal excitation generated by combustor acoustics and mechanical vibration. It is noted, however, that the manifold 122 and transition piece 116 need not be integral to provide vibration attenuation—arrangements in which the manifold radially-inward boundary 138 is a discrete element would also suffice, as long as the manifold 122 and transition piece 116 have contact sufficient to generate substantially the same the level of stiffness in the manifold as is found in the portion of the transition piece surrounding the secondary combustion region 114.

With continued reference to FIG. 3, the radially-inward wall or boundary 138 of the manifold 122 is characterized by a series of mounting holes 140 through which the injector nozzles 124,26 are inserted. The injector nozzles 124, 126 may be spaced apart from one another as desired. In one embodiment, the secondary injectors are spaced apart equidistant from one another. The radially-outward boundary or cover 142 of the manifold 122 includes access ports 144 which, when removed, provide access to the nozzles 124, 126 as needed. The nozzles 124, 126 and mounting holes 140 also include matching threads to allow for screw-in type mounting of the nozzles. In this manner, the nozzles may be replaced or moved as needed to accommodate a variety of circumferentially-varied flow profiles or engine operating conditions. Other mounting methods, such as welding or brazing would also suffice in applications where easily-removable mounting is not needed or desired.

In accordance with an aspect of the invention, the access ports 144 are formed into groups that help reduce thermal stress induced by differential thermal expansion between the inner and outer regions of manifold 138, 142. The temperature difference between the region inside 132 the transition piece and outside 148 the transition piece may be significant during operation and may cause a significant thermal stress to the body of manifold 22. For example, the temperature within secondary combustion zone 114 of transition piece 116 may be in the range of between about 1500° F. and about 1800° F. while the temperature outside of transition piece 116 may be between about 700° F. and 900° F., and typically about 800° F. In a preferred arrangement, the ports are arranged in groups of three, with the groups being spaced apart by heat dissipation gaps 150. The inclusion of these heat dissipation gaps 150 helps the secondary fuel delivery system 110 tolerate extended periods of cyclic thermal loading during operation. The heat dissipation gaps 150 may be formed in several ways, for example, the manifold outer cover 142 may include a plurality of segments 152, with each segment 152 adapted for placement over a plurality of injectors, and wherein a gap 150 is defined between each adjacent segment 152 of the manifold cover 142. The gaps 150 may also be directly machined into the manifold 122 when the manifold is formed. The injectors 124, 126 and manifold 122 may be made from Hastelloy-X, a nickel-chromium-iron-molybdenum alloy, or any other suitable high temperature material or metallic alloy. It is noted that the access ports 144 need not be arranged in groups of three, and the heat dissipation gaps 150 need not be uniformly distributed about the manifold, and may be left out altogether depending on the cooling requirements of a particular engine design.

As shown in FIG. 3, the manifold inlet port 134 is configured to receive a stream 112 of secondary fuel 128 and/or diluent 130 and to provide the stream to the injectors 124, 126. The secondary fuel 112 may be delivered by a line stemming from any suitable source, not shown, which may be the same as, or independent from, the primary fuel source, not shown. The diluent 130 may be a variety of materials, including air, steam, or an inert gas, such as nitrogen, for the reasons set forth below. The secondary fuel 128 and any additional material 130 may be premixed before entry into inlet 134 by passing the streams through a mixer or swirling vane, not shown, or may be introduced independently and mixed within manifold 122.

During operation, the stream of fuel and/or diluent enters the manifold inner cavity 125 through the manifold inlet port 134 and acts a cooling medium for the nozzles 124, 126 and transition piece 116 before entering the secondary combustion zone 114. To this end, as shown particularly in FIGS. 3 and 4, a flow-accelerating flowsleeve 146 is strategically located within the manifold 122, at a region 156, located generally opposite the manifold inlet port 134, to ensure that flow velocity is maintained at a level effective to provide transition cooling. The flowsleeve 146 preferably resembles a circumferentially-arcuate trough having opposite side panels 158 spaced apart by a blocking band 160 oriented generally-parallel to the radially-inward wall 138 of the manifold 122. During operation, the stream of fuel and/or diluent (or other fluid) flows between the manifold radially-inward boundary 138 and the blocking band 160. The injector nozzles 124, 126 extend through passthrough apertures 166 located in the flowsleeve blocking band 160, and the pass-through apertures 166 are sized to allow the secondary fuel/diluent stream 112 to flow radially outward, away from the manifold radially-inward boundary 138 and the blocking band 160, along the nozzle 124, 126 exteriors and then change direction to enter and flow through the nozzles, before exiting the manifold and travelling into the secondary combustion zone 114. The consequent increase in convection heat transfer in the area occupied by the flow sleeve 146 reduces the thermal gradients in this region, thereby reducing thermo-mechanical stresses. Moreover, the increase in velocity of the fluids moving through the region occupied by the flowsleeve 146 improves the heat transfer characteristics of the region and ensures adequate cooling. Without the flowsleeve 146 the portion of manifold 122 opposite the manifold inlet would likely experience thermo-mechanical stresses because the fuel-diluent mass flow is at a minimum in this region 156, it is also likely that without sufficient cooling, the material limits of the components would be reached or exceeded and failure could occur. In this embodiment, the region 156 occupied by the flowsleeve is centered approximately 180 degrees circumferentially-away from the manifold inlet port 134, extending along an arc about 120 degrees in length, but could be as narrow as about 10 degrees.

It is noted that the flared, or trough-like, flowsleeve shape described above provides increased flowsleeve volume, while maintaining a relatively-low manifold profile, thereby increasing the flow-accelerating efficiency of the manifold. Other arrangements, such as contoured or radially-aligned flowsleeve side panels 158 could also be used, depending on the degree of flow blockage desired along the circumferential span of the manifold. As noted above, the flowsleeve 146 is shown as circumferentially arcuate, but may be of any shape that allows the flowsleeve to fit within the manifold and which provides a volume sufficient to accelerate the secondary stream 112 of fuel and/or diluent as desired. The volume occupied by the flowsleeve 146 need not be uniform, but generally increases as a function of flow distance away from the inlet port 134 to compensate for flow velocity loss tendencies that increase in relation to this distance. The volume occupied by the flowsleeve 146 is proportional to the amount of flow rate increase desired in order to provide adequate cooling in regions where non-accelerated flow does not naturally provide sufficient cooling. It is noted that the flow sleeve 182 may be installed in a variety of circumferential positions within manifold 152, and the desired location of the flowsleeve may vary from application to application, but a flow sleeve 146 is appropriate when flow velocity in a region is less than about 60% of the nominal flow velocity (Vn) found immediately proximate the manifold inlet port 134, and the optimal dimensions of the flow sleeve side panels 158, blocking band 160, and pass-through apertures 166 is such that the resultant flow volume in the region occupied by the flowsleeve 146 is approximately 65% to 120% the nominal flow velocity Vn found in the vicinity of the inlet port. Accelerating to above the nominal velocity Vn is useful in applications of particularly-long flow distance, where temperature gradients between the transition interior are higher than average, or other settings in which the secondary fuel/diluent stream 112 exhibits a reduced ability to dissipate heat; as highly-accelerated flow in these regions can further increase flow turbulence and provide an increase in cooling.

Additionally, and with further reference to FIG. 4, the transition piece 116 may have a plurality of effusion cooling holes 168 disposed therein for allowing air to flow about and into the secondary combustion zone 114, thereby cooling the body of the transition piece. Diffusion holes 168 may be disposed at an angle from about 5 to about 45 degrees, and in one embodiment about 10 degrees, or may be any other suitable angle for enabling the cooling of the transition body.

It is to be understood that while certain forms of the invention have been illustrated and described, it is not to be limited to the specific forms or arrangement of parts herein described and shown. It will be apparent to those skilled in the art that various changes, including modifications, rearrangements and substitutions, may be made without departing from the scope of this invention and the invention is not to be considered limited to what is shown in the drawings and described in the specification. The scope of the invention is defined by the claims appended hereto.

What is claimed is:

1. A secondary fuel delivery system comprising:

an elongated transition piece adapted to fluidly connect a primary combustion zone and a combustion engine turbine section, said transition piece being characterized by an elongated boundary wall surrounding a secondary combustion zone;

a substantially-ring-shaped manifold formed integral with said boundary wall, said manifold including an inlet port adapted to fluidly link a manifold interior with a source of secondary fluid;

a plurality of injector nozzles fluidly linking said manifold interior with said secondary combustion zone;

a flow acceleration region located within said manifold at a location where non-accelerated secondary fluid flow velocity is less than about 60% of the secondary fluid flow velocity exhibited proximate said inlet port;

a flowsleeve located within said flow acceleration region of said manifold, said flowsleeve adapted to increase fluid flow volume within said acceleration region to a level between about 65% to 120% of said secondary fluid flow velocity exhibited proximate said inlet port, said flowsleeve representing a circumferentially-arcuate trough and including a blocking band constructed and arranged to divide said flow acceleration region of said manifold into a radially-inward portion and a radially-outward portion and having apertures through which said nozzles extend, said apertures fluidly connecting said manifold flow acceleration region radially-inward and radially-outward portions and being sized to allow said secondary fluid to flow radially outward from said radially-inward portion of said flow acceleration region, away from a manifold radially-inward boundary, along exteriors of said nozzles into said radially-outward of said flow acceleration region, and then change direction to enter and flow through the nozzles, before exiting the manifold and travelling into the secondary combustion zone;

said flowsleeve extending through a span having a circumferential span in the range of about 10 degrees to 120 degrees; and wherein said blocking band, said apperatures, and said radially inward and outer portions of said manifold flow acceleration region are constructed and arranged to cooperatively increase flow velocity within said flow acceleration region to provide increased heat dissipation around said nozzles, whereby said manifold exhibits increased stiffness and is resistant to vibration generated by said transition and wherein said flowsleeve compensates for secondary fluid cooling effectiveness losses at a region flow-wise-away from said inlet port.

2. The system of claim 1, wherein said secondary fluid is fuel.

3. The system of claim 2, wherein said secondary fluid further includes a diluent.

4. The system of claim 3, wherein said diluent is steam.

5. The system of claim 3, wherein diluent is an inert gas.

6. The system of claim 1, further including effusion cooling holes located within said transition boundary wall, in a region proximate said manifold.

7. The system of claim 6, wherein said cooling holes are generally disposed at an angle from about 5 to about 45 degrees with respect to the transition boundary wall.

8. The system of claim 1, wherein said manifold includes a radially-outward cover, said cover including at least one circumferentially-extending gap adapted to release thermal stresses during operation.

9. The system of claim 8, wherein at least one of said nozzles is threadably engaged with said manifold.

10. The system of claim 9, wherein said manifold cover further includes at least one removable cap through which at least one of said nozzles may be accessed.

* * * * *